US009056343B2

(12) United States Patent
Su et al.

(10) Patent No.: US 9,056,343 B2
(45) Date of Patent: Jun. 16, 2015

(54) COLD-ROLLING METHOD FOR PREVENTING FRACTURE OF HIGH-SILICON STRIP STEEL

(75) Inventors: Dejun Su, Shanghai (CN); Yong Li, Shanghai (CN); Runjie Lin, Shanghai (CN); Minghua Shen, Shanghai (CN); Hongbing Wang, Shanghai (CN); Huaqun Zhu, Shanghai (CN); Xuechang You, Shanghai (CN); Guiling Zhou, Shanghai (CN)

(73) Assignee: BAOSHAN IRON & STEEL CO., LTD. (CN)

( * ) Notice: Subject to any disclaimer, the term of this patent is extended or adjusted under 35 U.S.C. 154(b) by 232 days.

(21) Appl. No.: 13/576,115

(22) PCT Filed: Apr. 28, 2011

(86) PCT No.: PCT/CN2011/073415

§ 371 (c)(1),
(2), (4) Date: Jul. 30, 2012

(87) PCT Pub. No.: WO2012/068828

PCT Pub. Date: May 31, 2012

(65) Prior Publication Data

US 2012/0304721 A1 Dec. 6, 2012

(30) Foreign Application Priority Data

Nov. 26, 2010 (CN) ..... 2010 1 0562032

(51) Int. Cl.

| | |
|---|---|
| ***B21B 45/02*** | (2006.01) |
| ***B21B 3/02*** | (2006.01) |
| *B21B 13/14* | (2006.01) |
| *B21B 37/74* | (2006.01) |
| *B21B 1/22* | (2006.01) |

(52) U.S. Cl.

CPC ..... *B21B 45/02* (2013.01); *B21B 45/0218* (2013.01); *B21B 45/0251* (2013.01); *B21B 3/02* (2013.01); *B21B 13/147* (2013.01); *B21B 37/74* (2013.01); *B21B 2001/221* (2013.01); *B21B 2261/20* (2013.01)

(58) Field of Classification Search

CPC B21B 45/02; B21B 45/0203; B21B 45/0215; B21B 45/0218; B21B 45/0233; B21B 45/0239; B21B 45/0245; B21B 45/0251

USPC ..... 72/41–44, 200–202, 183, 205

See application file for complete search history.

(56) References Cited

U.S. PATENT DOCUMENTS

| | | | | |
|---|---|---|---|---|
| 3,908,432 | A * | 9/1975 | Ichiyama et al. | 72/365.2 |
| 6,216,516 | B1 * | 4/2001 | Klamma et al. | 72/205 |
| 6,497,127 | B2 * | 12/2002 | Nishiura et al. | 72/44 |
| 8,584,499 | B2 * | 11/2013 | Takahama et al. | 72/41 |
| 2001/0007808 | A1 * | 7/2001 | Mishima et al. | 72/54 |

FOREIGN PATENT DOCUMENTS

| | | | |
|---|---|---|---|
| CN | 1318438 | A | 10/2001 |
| CN | 101091965 | A | 12/2007 |
| CN | 101550480 | A | 10/2009 |
| CN | 201399466 | Y | 2/2010 |
| JP | 57-181719 | A | 9/1982 |
| JP | 57-181719 | A | 11/1982 |
| JP | 2001-321809 | A | 11/2001 |
| JP | 2003-061325 | A | 2/2003 |
| JP | 2004-18610 | A | 1/2004 |
| JP | 2004-323972 | A | 11/2004 |
| JP | 2006-198661 | A | 3/2006 |
| JP | 2008-194721 | A | 8/2008 |
| KR | 1005619960000 | A | 3/2006 |

OTHER PUBLICATIONS

English Translation of International Search Report dated Sep. 8, 2011, in International Application No. PCT/CN2011/073415; International Filing Date: Apr. 28, 2011; Applicant: Baoshan Iron & Steel Co., Ltd.

Xu Yuemin, producing technology for cold rolling silicon steel by Sendzimir mill, Wisco Technology, Nov. 1998, Vol, 36, No. 11, table 2, p. 50.

International Search Report dated Sep. 8, 2011, in International Application No. PCT/CN2011/073415; International Filing Date: Apr. 28, 2011; Applicant: Baoshan Iron & Steel Co., Ltd.

* cited by examiner

*Primary Examiner* — Shelley Self
*Assistant Examiner* — Pradeep C Battula
(74) *Attorney, Agent, or Firm* — Hovey Williams LLP

(57) ABSTRACT

A cold-rolling method for preventing fracture of high-silicon strip steel, characterized in that the high-silicon strip steel has a Si content ≥2.3 wt %, and at the beginning of cold-rolling, the temperature of inlet strip steel is above 45° C.; during the cold-rolling process, an emulsion liquid is sputtered to the strip steel, a flow rate of the emulsion liquid is 3500 L/min at the inlet in rolling direction, a flow rate of the emulsion liquid is 1500-4000 L/min at an outlet in the rolling direction, and the temperature of the strip steel is maintained above 45° C. under the precondition to guarantee technological lubrication. The cold-rolling method of the invention might prevent fracture of a head portion and a tail portion of the strip steel, raise the rate of finished products, and increase production efficiency.

2 Claims, No Drawings

COLD-ROLLING METHOD FOR PREVENTING FRACTURE OF HIGH-SILICON STRIP STEEL

FIELD OF THE INVENTION

This invention relates generally to a rolling technique for silicon steel, and particularly, to a cold-rolling method for preventing fracture of high-silicon strip steel (Si content ≥2.3%) during rolling by a uni-stand reversible rolling mill or a tandem mill.

BACKGROUND

Silicon steel is a soft magnetic material with excellent magnetic property and is widely used in the production of various industrial products and household appliances. However, the production process for the silicon steel is rather complicated and difficult. In particular, fracture of high-silicon strip steel during cold-rolling process is always a difficult problem for various steelworks. With an increase of Si content, the alloy yield limit, strength limit and hardness of the material all increase, meanwhile, the material becomes more brittle and its ductility decreases, and all these bring about difficulties for rolling process for high-silicon materials.

Before in-situ cold-rolling process, oriented silicon steel and high-grade non-oriented silicon steel are required to undergo a preheating procedure. Because of reasons such as rolling pace, heat dissipation, cooling, etc., the temperature of a part of the head portion and the tail portion of the strip steel is often somewhat lower than its middle portion, so that rolling stability is poor, and fracture occurs regularly during cold-rolling (especially for the head portion and tail portion of a strip steel, as the fracture times of the head portion and tail portion of the strip steel amount to 70% of total fracture times), and thus production efficiency and equipment safety are seriously affected.

SUMMARY

An object of the invention is to provide a cold-rolling method for preventing fracture of high-silicon strip steel. For high-silicon strip steel with a Si content ≥2.3%, the method might reduce fracture events for the head portion and the tail portion of the steel strip, raise ratio of finished products, improve production efficiency and thus create economic benefit remarkably.

The solution of the invention is as follows.

A cold-rolling method for preventing fracture of high-silicon strip steel, wherein the high-silicon strip steel has Si content ≥2.3 wt %. At the beginning of cold-rolling, the temperature of inlet strip steel is above 45° C.; during the cold-rolling process, emulsion liquid is sputtered to the strip steel, the flow rate of the emulsion liquid is less than or equal to 3500 L/min at the inlet in rolling direction, the flow rate of the emulsion liquid is 1500-4000 L/min at the outlet in rolling direction, and the temperature of the strip steel is ensured being above 45° C. under the precondition to guarantee technological lubrication.

Furthermore, during the cold-rolling process:

for the first pass of rolling, the reduction ratio is 20-40%, a rearward unit tension is 8-30 N/mm$^2$ and a forward unit tension is 50-200 N/mm$^2$; for the middle passes of rolling, the reduction ratio is 18-38%, a rearward unit tension is 40-150 N/mm$^2$, and a forward unit tension is 60-350 N/mm$^2$; for the finish pass of rolling, the reduction ratio is 15-35%, a rearward unit tension is 60-300 N/mm$^2$, and a forward unit tension is 90-450 N/mm$^2$.

Before the cold-rolling process, oriented silicon steel and high-grade non-oriented silicon steel are required to undergo a preheating procedure (in manner of water bath, induction, etc.). Because of reasons such as rolling pace, heat dissipation, cooling, etc., the temperature of a part of the head portion and the tail portion of the strip steel is often somewhat lower than its middle portion, so that rolling stability is poor, and fracture occurs regularly during cold-rolling, and thus production efficiency and equipment safety are seriously affected.

In production process of cold-rolled strip materials, if the processing temperature is low, then work hardening to different degrees occurs during the rolling process. Such work hardening will increase the metal deformation resistance during the rolling and make the rolling pressure rise. For a certain steel grade, the work hardening level is in relation to the deformation degree caused by cold-rolling. Due to the work hardening, finished products of cold-rolled strip steel are required to pass through a certain heat treatment before finishing so as to soften the metal and to improve comprehensive performance of the finished product or to acquire desired special texture and properties.

The cold-rolling process of the invention utilizes technological cooling and technological lubrication.

Deformation heat and friction heat generated during cold-rolling process causes temperatures of both the rolled pieces and the roller to rise. An excessively high temperature of the surface of the rollers will cause a decrease in the hardness of the quenched layer of working roller, and will be possible to promote metallographic texture in the quenched layer to decompose and thus to generate additional texture stress in the surface of the roller. In addition, an excessively high temperature of both the rolled pieces' surface and the roller's surface will impair lubrication oil film between the interface of the two, so as to cause hot welding in local areas between the rolled pieces and roller, which further damages surfaces of the rolled pieces and the roller, which are so called "hot scratch". Therefore, it is necessary to apply effective lubricating emulsion liquid during the cold rolling process.

The main purpose of technological lubrication by using the emulsion liquid during cold rolling is to reduce the deformation resistance of the metal, in order to not only obtain higher reduction ratio in capability of existing equipment but also enable rolling equipment to economically produce cold-rolled products with a smaller thickness. Moreover, efficient technological lubrication has advantageous impacts on heat generation and temperature rise of rollers during cold-rolling. When some specific categories of steel products are cold rolled, the efficient technological lubrication can further prevent the metal from adhering onto the rollers.

As a preferred solution, the method of the present invention provides optimized control to tension rolling in a cold-rolling process.

In existing cold rolling process, the tension rolling refers to rolling deformation of the rolled piece that is done under the action of a certain forward tension and a certain rearward tension. The purpose of the tension is to prevent the strip piece from running deviation in the rolling process, to keep the strip piece to be cold-rolled straight and planar, to reduce deformation resistance of metal, to be adapted for rolling thinner products, and to properly adjust the load of the main motor of a cold-rolling mill.

In consideration of a fact that a material with a high Si content is susceptible to brittle fracture and of a control of straightness and running deviation, the present invention utilizes, in cold rolling process, a relatively high reduction ratio and a relatively small tension to further eliminate occurrence of fracture of strip steel being cold-rolled, which is quite beneficial.

The beneficial effects of the invention:

The present invention exerts pertinent process control on areas of the head portion and the tail portion of a strip steel with a relatively low temperature, so as to overcome the shortcomings of the prior art, and have advantages such as low fracture occurrence ratio, high finished product ratio, and high operation efficiency of a cold-rolling mill.

By way of example, the technique of the invention is applied to a single-stand Sendzimir mill with 20 rollers to cold-roll a strip steel with a thickness less than 0.3 mm. By applying the present invention, fracture ratio is reduced by about 80.6%, and both production rate and operation efficiency are improved greatly, and thereby resulting in a good economic benefit.

The technique of the invention is applicable to uni-stand, 4-stand, 5-stand, and 6-stand cold-rolling mills and so on, to experimentally determine the brittleness temperature range of different categories of steels.

DETAILED DESCRIPTION

The invention is now described in detail in a combination of embodiments.

A cold-rolling method is provided for preventing fracture of high-silicon strip steel with a Si content ≥2.3 wt %. At the beginning of the cold-rolling, the temperature of the inlet strip steel is above 45° C.; during the cold-rolling process, an emulsion liquid is sputtered to the strip steel, the flow rate of the emulsion liquid is less than or equal to 3500 L/min at the inlet in rolling direction, the flow rate of the emulsion liquid is 1500-4000 L/min at the outlet in the rolling direction, and the temperature of the strip is maintained above 45° C. under the precondition to guarantee technological lubrication.

During the cold-rolling process: for the first pass of rolling, the reduction ratio is 20-40%, a rearward unit tension is 8-30 N/mm$^2$ and a forward unit tension is 50-200 N/mm$^2$; for middle passes of rolling, the reduction ratio is 18-38%, a rearward unit tension is 40-150 N/mm$^2$ and a forward unit tension is 60-350 N/mm$^2$; for finish pass of rolling, the reduction ratio is 15-35%, a rearward unit tension is 60-300 N/mm$^2$ and a forward unit tension is 90-450 N/mm$^2$.

Embodiment 1

High-silicon strip steel has a Si content of 2.7 wt %. At the beginning of cold rolling, the temperature of inlet strip steel is above 45° C.; during the cold-rolling process, an emulsion liquid is sputtered to the strip steel, the flow rate of the emulsion liquid is 3000 L/min at the inlet in rolling direction, the flow rate of the emulsion liquid is 3500 L/min at the outlet in the rolling direction, and the temperature of the strip steel is maintained above 45° C. under the precondition to guarantee technological lubrication.

During the cold-rolling process: for the first pass of rolling, the reduction ratio is 28%, a rearward unit tension is 10 N/mm$^2$ and a forward unit tension is 80 N/mm$^2$; for the middle passes of rolling, the reduction ratios are 18-30%, a rearward unit tension is 40-150N/mm$^2$ and a forward unit tension is 60-350 N/mm$^2$; for the finish pass of rolling, the reduction ratio is 23%, a rearward unit tension is 90 N/mm$^2$ and a forward unit tension is 190 N/mm$^2$.

Embodiment 2

High-silicon strip steel has a Si content of 3.0 wt %. At the beginning of cold-rolling, the temperature of inlet strip steel is above 50° C.; during the cold-rolling process, an emulsion liquid is sputtered to the strip steel, the flow rate of the emulsion liquid is 2000 L/min at the inlet in the rolling direction, the flow rate of the emulsion liquid is 3000 L/min at the outlet in the rolling direction, and the temperature of the strip steel is maintained above 50° C. under the precondition to guarantee technological lubrication.

During the cold-rolling process: for the first pass of rolling, the reduction ratio is 31%, a rearward unit tension is 20 N/mm$^2$ and a forward unit tension is 160 N/mm$^2$; for the middle passes of rolling, the reduction ratios are 20-28%, a rearward unit tension is 50-140 N/mm$^2$ and a forward unit tension is 60-350 N/mm$^2$; for the finish pass of rolling, the reduction ratio is 30%, a rearward unit tension is 180 N/mm$^2$ and a forward unit tension is 310 N/mm$^2$.

Embodiment 3

High-silicon strip steel has a Si content of 3.1 wt %. At the beginning of cold-rolling, the temperature of inlet strip steel is above 55° C.; during the cold-rolling process, an emulsion liquid is sputtered to the strip steel, the flow rate of the emulsion liquid is 1000 L/min at the inlet in the rolling direction, the flow rate of the emulsion liquid is 2000 L/min at outlet in the rolling direction, and the temperature of the strip steel is maintained above 55° C. under the precondition to guarantee technological lubrication.

During the cold-rolling process: for the first pass of rolling, the reduction ratio is 36%, a rearward unit tension is 30 N/mm$^2$ and a forward unit tension is 190 N/mm$^2$; for the middle passes of rolling, the reduction ratios are 18-25%, a rearward unit tension is 44-120 N/mm$^2$ and a forward unit tension is 70-300 N/mm$^2$; for the finish pass of rolling, the reduction ratio is 33%, a rearward unit tension is 260 N/mm$^2$ and a forward unit tension is 400 N/mm$^2$.

Embodiment 4

High-silicon strip steel has a Si content of 2.4 wt %. At the beginning of cold rolling, the temperature of inlet strip steel is above 50° C.; during the cold-rolling process, an emulsion liquid is sputtered to the strip steel, the flow rate of the emulsion liquid is 2800 L/min at the inlet in rolling direction, the flow rate of the emulsion liquid is 1600 L/min at the outlet in the rolling direction, and the temperature of the strip steel is maintained above 50° C. under the precondition to guarantee technological lubrication.

During the cold-rolling process: for the first pass of rolling, the reduction ratio is 22%, a rearward unit tension is 9 N/mm$^2$ and a forward unit tension is 65 N/mm$^2$; for the middle passes of rolling, the reduction ratios are 16-28%, a rearward unit tension is 40-145 N/mm$^2$ and a forward unit tension is 65-340 N/mm$^2$; for the finish pass of rolling, the reduction ratio is 24%, a rearward unit tension is 70 N/mm$^2$ and a forward unit tension is 120 N/mm$^2$.

Embodiment 5

High-silicon strip steel has a Si content of 3.2 wt %. At the beginning of cold-rolling, the temperature of inlet strip steel is above 55° C.; during the cold-rolling process an emulsion liquid is sputtered to the strip steel, the flow rate of the emulsion liquid is 1500 L/min at the inlet in rolling direction, the flow rate of the emulsion liquid is 2200 L/min at the outlet in the rolling direction, and the temperature of the strip steel is maintained above 58° C. under the precondition to guarantee technological lubrication.

During the cold-rolling process: for the first pass of rolling, the reduction ratio is 27%, a rearward unit tension is 25 N/mm$^2$ and a forward unit tension is 170 N/mm$^2$; for the middle passes of rolling, the reduction ratios are 20-25%, a rearward unit tension is 40-140 N/mm$^2$ and a forward unit tension is 60-330 N/mm$^2$; for the finish pass of rolling, the reduction ratio is 20%, a rearward unit tension is 220 $N/mm^2$ and a forward unit tension is 330 $N/mm^2$.

What is claimed is:

1. A cold-rolling process for preventing fracture of high-silicon strip steel having a thickness of less than 0.3 millimeters and having a Si content ≥2.3 wt. %, the process comprising:

at the beginning of the cold-rolling process, the temperature of inlet strip steel is above 45° C.;

during the cold-rolling process, an emulsion liquid is sputtered to the strip steel, a flow rate of the emulsion liquid is 3500 L/min at the inlet in a rolling direction, a flow rate of the emulsion liquid is 1500-4000 L/min at an outlet in the rolling direction, and the temperature of the strip steel is maintained above 45° C. under the precondition to guarantee technological lubrication;

for a first pass of rolling, a reduction ratio is 20-40%, a rearward unit tension is 8-30 $N/mm^2$ and a forward unit tension is 50-200 $N/mm^2$;

for middle passes of rolling, the reduction ratios are 18-38%, a rearward unit tension is 40-150 $N/mm^2$ and a forward unit tension is 60-350 $N/mm^2$; and for a finish pass of rolling, a reduction ratio is 15-35%, a rearward unit tension is 60-300 $N/mm^2$ and a forward unit tension is 90-450 $N/mm^2$.

2. A cold-rolling process for preventing fracture of high-silicon strip steel having a thickness of less than 0.3 millimeters and having a Si content of 2.7 wt. %, the process comprising:

at the beginning of the cold-rolling process, the temperature of inlet strip steel is above 45° C.;

during the cold-rolling process, an emulsion liquid is sputtered to the strip steel, a flow rate of the emulsion liquid is 3000 L/min at the inlet in a rolling direction, a flow rate of the emulsion liquid is 3500 L/min at an outlet in the rolling direction, and the temperature of the strip steel is maintained above 45° C. under the precondition to guarantee technological lubrication;

for a first pass of rolling, a reduction ratio is 28%, a rearward unit tension is 10 $N/mm^2$ and a forward unit tension is 80 $N/mm^2$;

for middle passes of rolling, the reduction ratios are 18-30%, a rearward unit tension is 40-150 $N/mm^2$ and a forward unit tension is 60-350 $N/mm^2$; and for a finish pass of rolling, a reduction ratio is 23%, a rearward unit tension is 90 $N/mm^2$ and a forward unit tension is 190 $N/mm^2$.

* * * * *